US006491212B1

(12) United States Patent
Militzer

(10) Patent No.: US 6,491,212 B1
(45) Date of Patent: Dec. 10, 2002

(54) FOLDABLE AND STACKABLE BOX ASSEMBLY

(76) Inventor: George G. Militzer, 1402 Carleton Square, San Diego, CA (US) 92106

( * ) Notice: Subject to any disclaimer, the term of this patent is extended or adjusted under 35 U.S.C. 154(b) by 0 days.

(21) Appl. No.: 09/766,457

(22) Filed: Jan. 19, 2001

(51) Int. Cl.[7] ..... B65D 5/38

(52) U.S. Cl. ..... 229/125.125; 229/117.09; 229/117.12; 229/125.01; 229/193; 229/194; 229/171; 229/931; 229/156; 229/172; 229/120

(58) Field of Search ..... 229/125.125, 117.09, 229/125.01, 125.12, 117.12, 117.11, 194, 193, 190, 171, 165, 920, 931, 155, 156, 126, 172, 173, 174, 177, 178, 120

(56) References Cited

U.S. PATENT DOCUMENTS

| | | | | | |
|---|---|---|---|---|---|
| 528,763 | A | * | 11/1894 | Craw | 229/125.125 X |
| 659,651 | A | * | 10/1900 | Cowles | 229/125.125 |
| 944,063 | A | | 12/1909 | Warren | |
| 1,288,895 | A | * | 12/1918 | Houghland | 229/156 |
| 1,597,652 | A | | 8/1926 | Kadan | |
| 2,579,880 | A | | 12/1951 | Stue | |
| 2,936,944 | A | | 5/1960 | Moore | |
| 3,258,192 | A | * | 6/1966 | Kelty | 229/156 X |
| 3,310,219 | A | * | 3/1967 | Dlugopolski | 229/117.12 |
| 3,316,102 | A | * | 4/1967 | Doll et al. | 229/116 X |
| 3,423,006 | A | * | 1/1969 | Stedman | 229/125.125 |
| 3,531,041 | A | * | 9/1970 | Rohde | 229/117.12 |
| 3,684,084 | A | * | 8/1972 | Kanzelberger | 229/125.125 |
| 3,820,706 | A | * | 6/1974 | Gibson et al. | 229/194 X |
| 4,022,372 | A | * | 5/1977 | Graser | 229/931 X |
| 4,244,508 | A | | 1/1981 | Schulman | |
| 4,339,069 | A | * | 7/1982 | Poteet | 229/194 |
| 4,770,339 | A | * | 9/1988 | Weimer | 229/174 X |
| 5,193,671 | A | | 3/1993 | Patterson | |
| 6,098,873 | A | * | 8/2000 | Sheffer | 229/178 |

* cited by examiner

*Primary Examiner*—Lee Young
*Assistant Examiner*—Tri M. Mai
(74) *Attorney, Agent, or Firm*—Frank G. Morkunas

(57) ABSTRACT

A foldable, stackable box assembly, having a collapsible sleeve component and a foldable container which is insertable into and out of the sleeve by a built-in handle mechanism. The container and sleeve are formed of these folding blanks which, when assembled, create a sturdy, slidable drawer-like box assembly. The front of the container has a compressible handle-like mechanism. It is a characteristic of the container/drawer that the front wall has, extending down from the top, a panel which extends forwardly and terminates short of the bottom of the front of the container/drawer. It is held there by compressible panels, and forms the handle mechanism under which a user can insert hand or finger to pull out the container/drawer from the sleeve.

13 Claims, 20 Drawing Sheets

FOLDABLE AND STACKABLE BOX ASSEMBLY

CROSS REFERENCES TO RELATED APPLICATIONS

Not applicable.

STATEMENT REGARDING FEDERALLY-SPONSORED RESEARCH OR DEVELOPMENT

Not applicable.

BACKGROUND OF THE INVENTION

This present invention relates to an improvement in knock-down, collapsible, foldable boxes, and more particularly to shoe boxes for easy storage and shipment, both in the knock-down or assembled state while transporting shoes and, when set up and configured for use, are stackable upon one another and have a removable drawer-like container which, when removed, permits easy retrieval of the shoes within, especially in a shoe store, without adversely affecting the remainder of the stack. It must be understood that, though this invention was prompted by a need for better shoe boxes adapted to storage (in both shoe manufacturing and in retail stores), retrieval, and return, it is capable of being used for any product storage and is not limited to shoes and shoe boxes.

Currently shoes are shipped from manufacturer or distributor to a retailer in a pre-formed, generally pasted, shoe box. The typical box has a bottom part and a top part. The bottom part has a base or bottom with four upstanding walls which form a container. The top part is the cover which has an upper base with four downwardly extending walls which snugly fit around the four upstanding walls to cover the opening of the bottom part. Typically the four downwardly extending walls are considerably shorter in length than are the four upstanding walls. This box thus is a pasted-up open-top box closed by a removable lid adapted to fit snugly around the outside of the open-top of the box.

It is customary in shoe stores to stack such boxes on top of one another and to have numerous such stacks or columns abutting one another. In such stacking configurations, the stacks can be extremely high consisting of many boxes stacked upon one another. Stacking and columning are generally done in some organized fashion by style and size for example. Shoe boxes such as these generally have information about the shoe style, size, and color which is printed on one or more of their upstanding walls. When a shoe salesperson, for instance, needs a pair of shoes which are in a box on top of the stack, there is no problem in merely taking that box out to the showroom and returning it to the same location without disrupting the organization of the stacks. When a desired shoe is in a box or boxes below the top of a stack, in the middle, or at or near the bottom, pulling the box from the stack is more difficult. Box tops and bottoms can get damaged.

For organizational purposes, it is best that the space created by the removed box remain unfilled so that, if a sale is not consummated, the box may be returned to its proper organizational location. This is not what usually occurs however. Once a box is removed from the stack, the boxes in that stack above the removed box simply fall into the space created by the removed box. Given the configuration of the box and lid, the descent generally is not smooth and orderly thereby creating an unsightly, scattered, appearance and unsettling the organization of the stacks.

The present invention eliminates the bulk associated with shipping the pre-formed pasted boxes to the shoe manufacturer, for example, and eliminates the problems associated with removing boxes from their stacks in the retail shoe store. In addition, the present invention, with its sleeve, slidable and removable container, permits re-use of the container and placement of the container into its original or any vacant sleeve.

Accordingly, several objects and advantages of my invention are to:

a. provide boxes which are easy to manufacture and less bulky to ship to the shoe manufacturer, to the retailer, and to an end-user;

b. provide boxes for products which are stackable and maintain their stack integrity after the container portion of a box is removed from the stack;

c. provide boxes for products which facilitate retrieval of the product therefrom and return thereto;

d. provide boxes for products which are not limited to a single product size and style but which are relatively fungible and re-usable; and e. provide product boxes which facilitate reorganization of a retailer's product inventory.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a knock-down, foldable, collapsible, stackable box assembly which has a sleeve and a removable container insertable into and out of the sleeve. The container and sleeve are formed of folding blanks which, when folded and assembled, create a sturdy, slidable drawer-like box assembly with the inner container being the removable drawer. The front of the container has a compressible handle-like mechanism which, when one or more box assemblies are shipped together, especially in large shipping containers, compresses without damage to its structure or function. When not in use by the retail purchaser or end-user, the sleeve may be unfolded and collapsed flat and the container may be unfolded and unassembled into a flat blank. When needed, each is easily re-folded, re-assembled into useable box, drawer-like structures. Any suitable materials may be used for the box assembly but a cardboard or cardboard-like materials are best.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
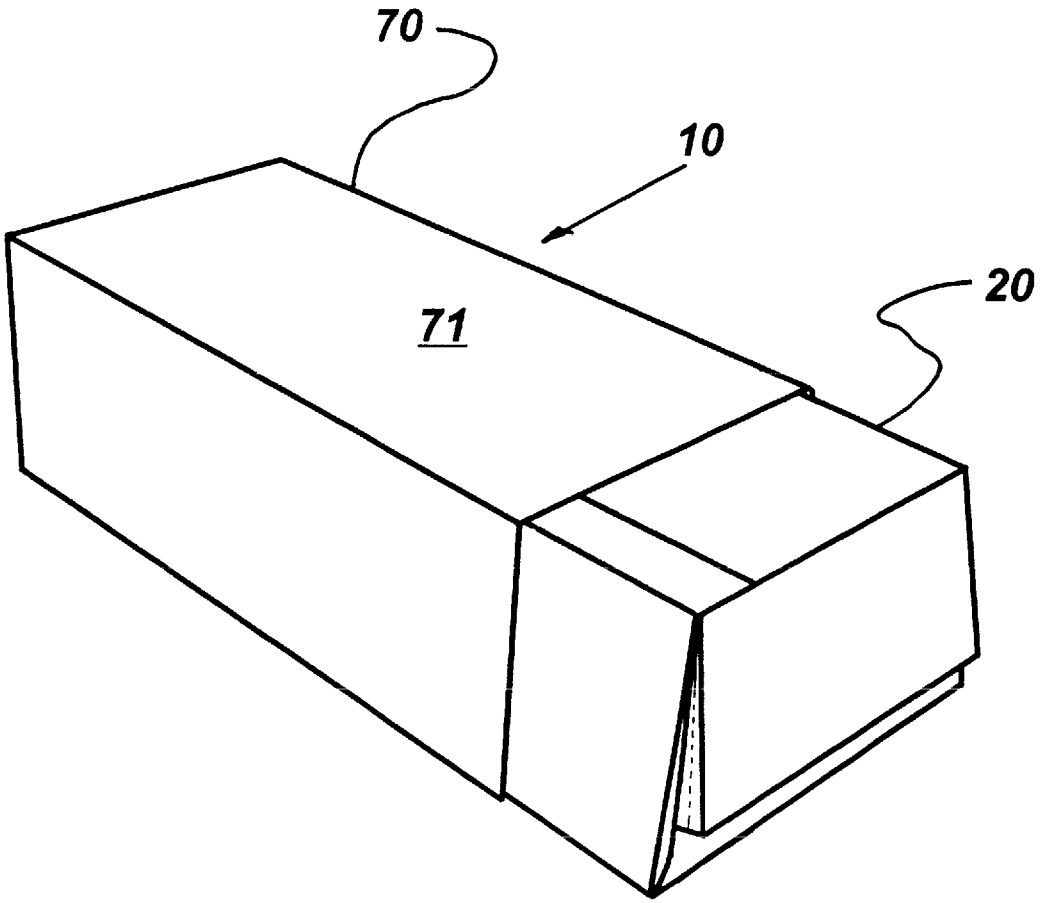
FIG. 1 is a perspective view of the assembled box assembly.
Figure 2:
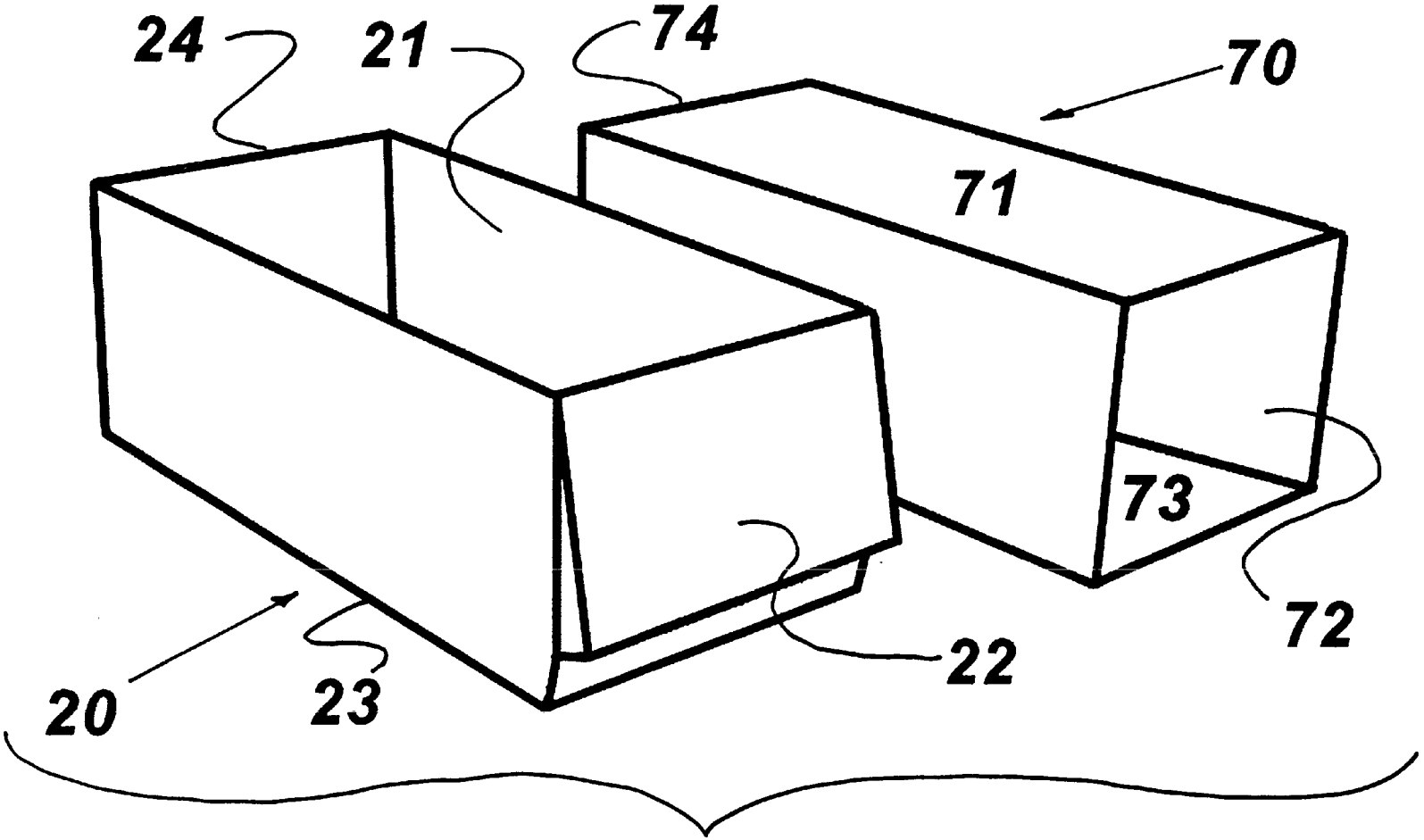
FIG. 2 is a perspective view of the two major components of the box assembly; its container and its sleeve.

Referring now to the drawings in detail and in particular to FIGS. 1 and 2, reference character 10 of FIG. 1 generally designates a knock-down, collapsible, foldable, stackable box assembly constructed in accordance with a preferred embodiment of the present invention. The two main components of the box assembly 10 include the container 20 and the sleeve 70. The container 20 is the inner open-top container which functions like a drawer when assembled and inserted into the sleeve 70. As illustrated in these figures, it has a rear side 24, a bottom 23, an opening 21 on top, and a handle-like structure or handle mechanism at the front 22. The sleeve 70 has a rear, 74 a bottom 73, a top 71, and an open front 72.

Figure 3:
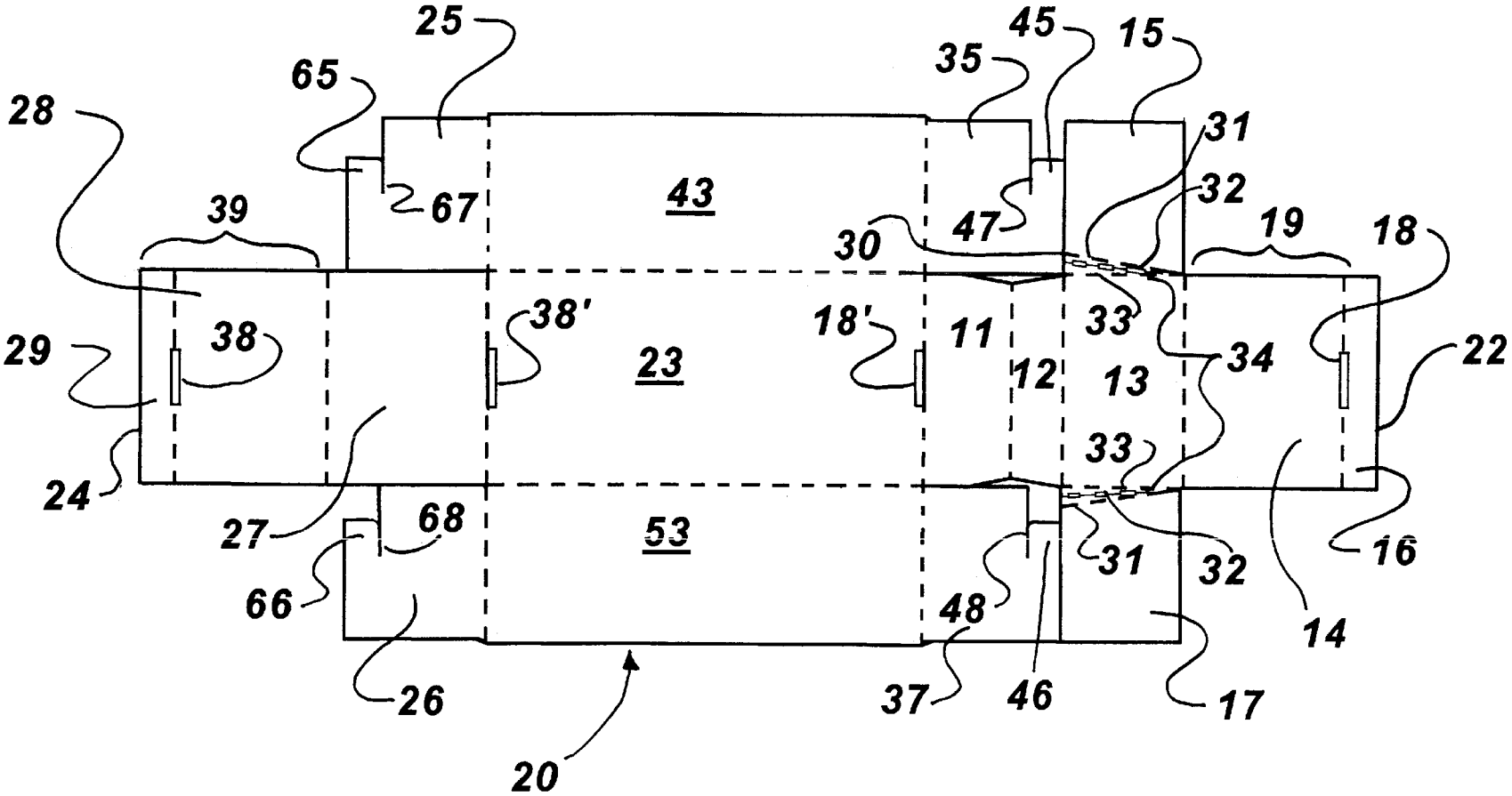
FIG. 3 is a plan view of the unassembled container component of the box assembly.
Figure 4:
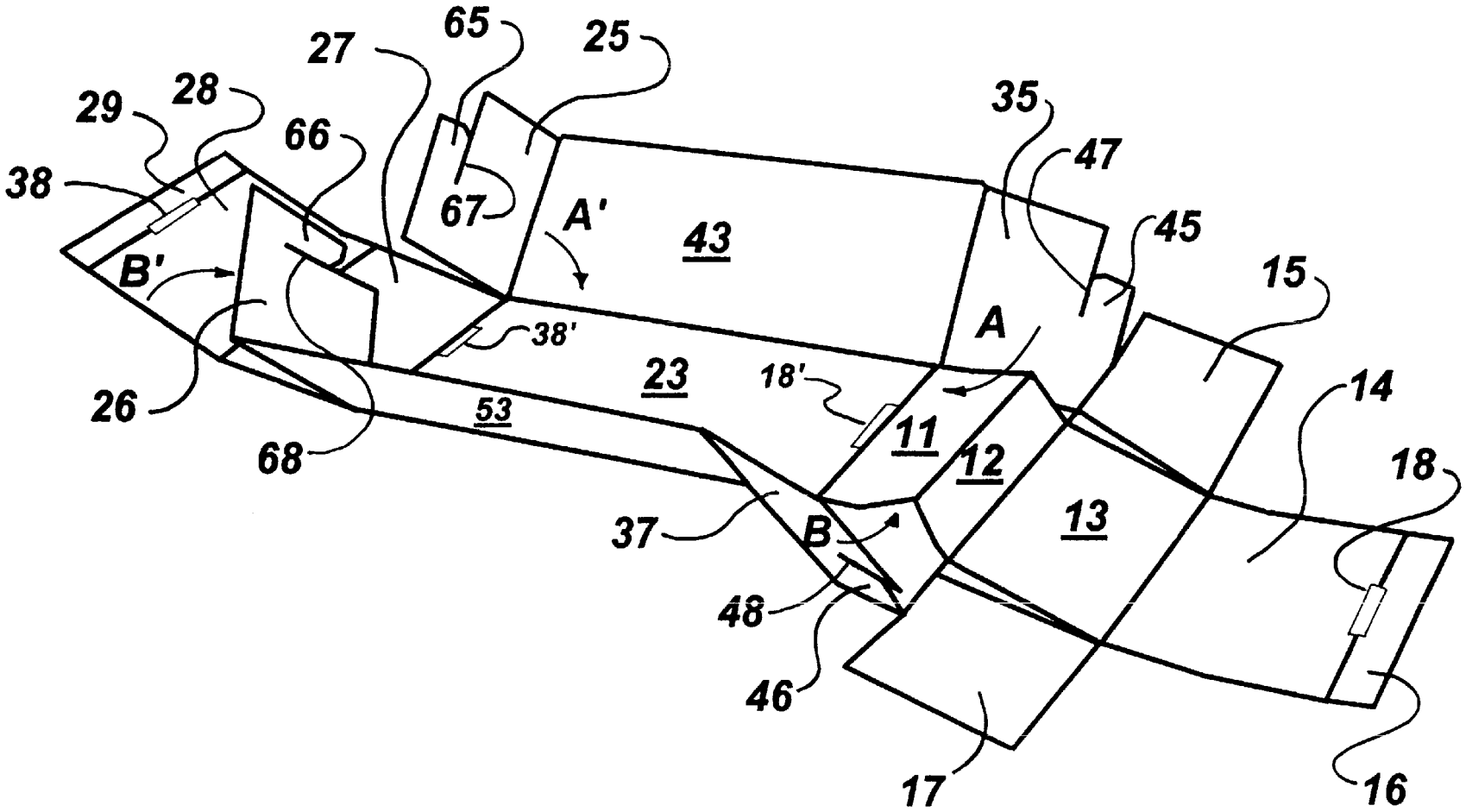
FIGS. 4–7 and 9–14 are views of the container component in various stages of assembly.

FIG. 3 represents the container blank 20 in its unfolded state. For the sake of clarity, the dotted lines of this figure only represent fold-lines. As illustrated here the container 20 has a bottom 23 with a front receiving slot 18' and a rear receiving slot 38'. A front-end assembly 19 extends forward and outward from the bottom 23 which, when the front-end assemble 19 is folded and assembled, forms the front 22 of the container 20 and also forms a compressible handle mechanism therefor. As shown here, the front-end assembly 19 has a first front panel 11 which is foldably connected to the bottom 23 front, followed by a second front panel 12 which is foldably connected to the first front panel 11, followed by a third front panel 13 which is foldably connected to the second front panel 12, followed by a fourth front panel 14 which is foldably connected to the third front panel 13, followed by the fifth front panel 16 which is foldably connected to the fourth front panel 14. At least four such front panels are required for this container but a fifth, or more, front panels may be so connected. The main purpose of the fifth front panel 16 will be explained as the assembly of the container is more fully described herein. Adjacent to the far end of the fourth front panel 14, on or near the fold-line between the fourth and fifth front panels, is a front tab 18 which, when the front-end assembly 19 of the container 20 is assembled, will securingly mate with receiving slot 18'.

An extension flap 15, 17 is foldably connected to each side of the third front panel 13. Fold lines 31, 32, 33 in conjunction with one or more slots 34 form an expansion section 30, 30' (illustrated in greater detail in FIG. 8) for the connection of the extension flaps 15, 17 to the third front panel 13. The first, second, and third front panels 11, 12, 13, in conjunction with the extension flaps 15, 17 will, when the front-end assembly 19 is folded and assembled, form a handle or grabbing mechanism to facilitate the translation of the container 20 in and out of the sleeve 70 and will also provide sound structural support for the front of the container 20.

A rear-end assembly 39 extends rear ward and outward from the bottom 23 which, when the rear-end assembly 39 is folded and assembled, forms the completed, structurally sound, rear 24 of the container 20. As illustrated, the rear-end assembly 39 has a first rear panel 27 which is foldably connected to the bottom 23 rear, followed by a second rear panel 28 which is foldably connected to the first rear panel 27, followed by a third rear panel 29 which is foldably connected to the second rear panel 28. At least two such rear panels are required for this container 20 but a third, or more, rear panels may be so connected. The main purpose of the third rear panel 29 will be explained as the assembly of the container 20 is more fully described. Adjacent to the far end of the second rear panel 28, at or near the fold-line of the second and third rear panels, is a rear tab 38 which, when the container 20 is assembled, will securingly mate with receiving slot 38'.

A first-side assembly 43 and a second-side assembly 53 are foldably connected to opposing sides of the bottom 23 of the container 20. For reference purposes, these respectively form a right side and a left side for the container 20. Each side assembly 43, 53 has a front-side lockable flap 35, 37, respectively, and a rear-side lockable flap 25, 26, respectively. The right front-side lockable flap 35 has an extension tab 45 and a slit 47 which, when folded and assembled, securely mate with the extension tab 46 and slit 48 of the left front-side lockable flap 37. Similarly, the right rear-side lockable flap 25 has an extension tab 65 and a slit 67 which, when folded and assembled, securely mate with the extension tab 66 and slit 68 of the left rear-side lockable flap 26. When so folded and assembled, the container 20 has a secure front, rear, and side foundations. As will be described the completed assemblies of the front-end assembly 19 and the rear-end assembly 39 over the front and rear of the container 20 further buttresses the structural integrity of the container's front and rear and provides the necessary strength to support stacking.

Figure 5:
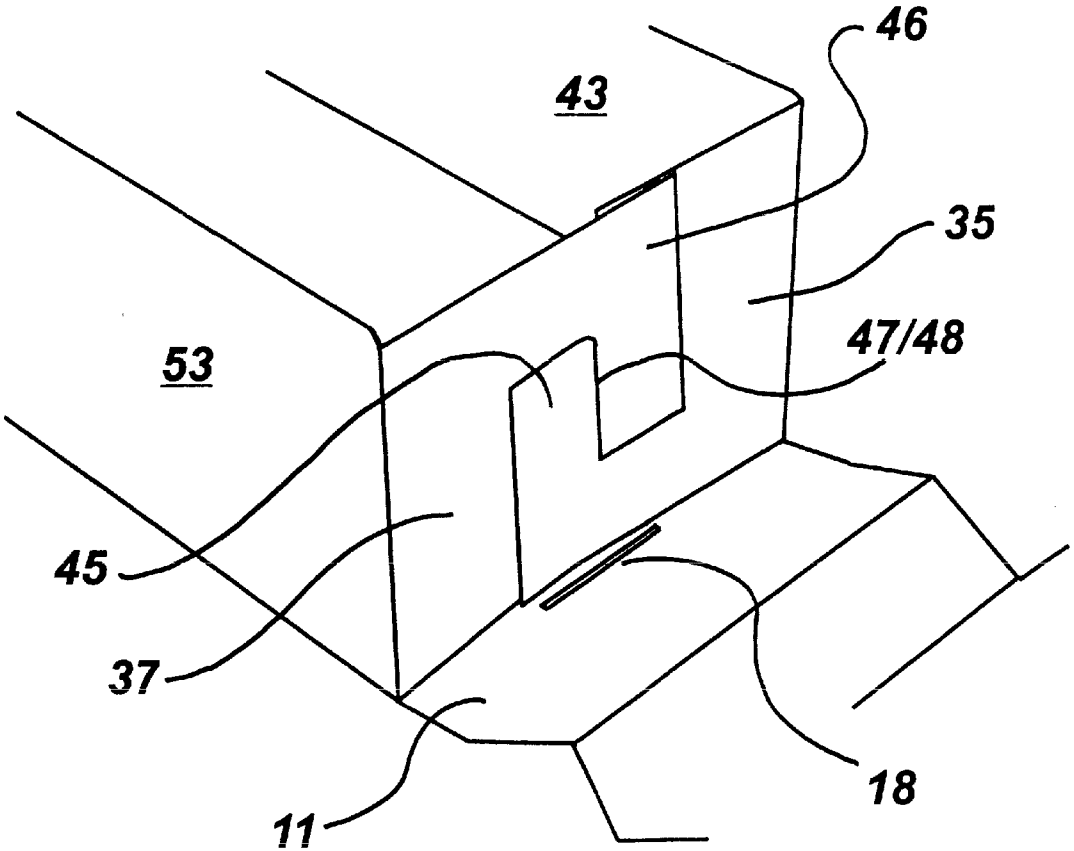
Figure 6:
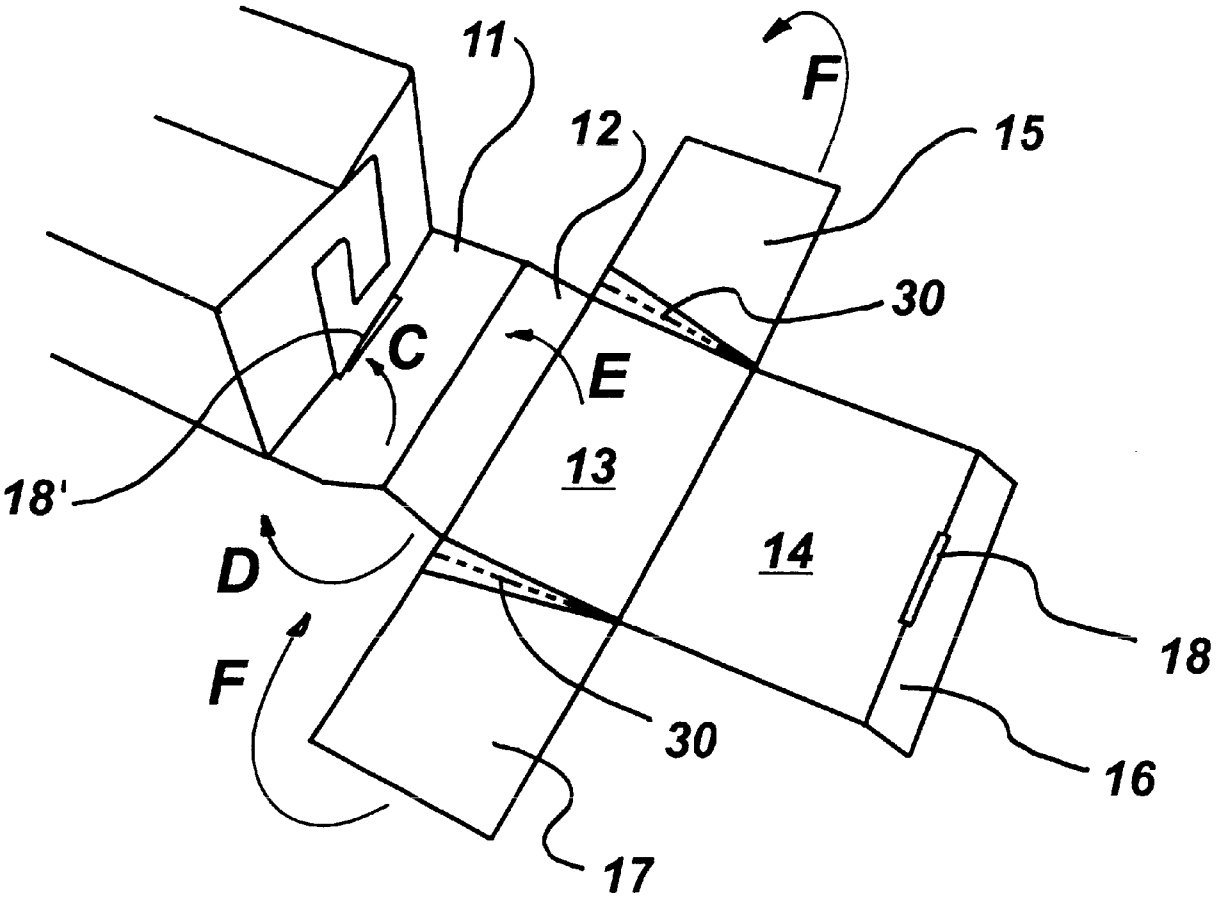
Figure 7:
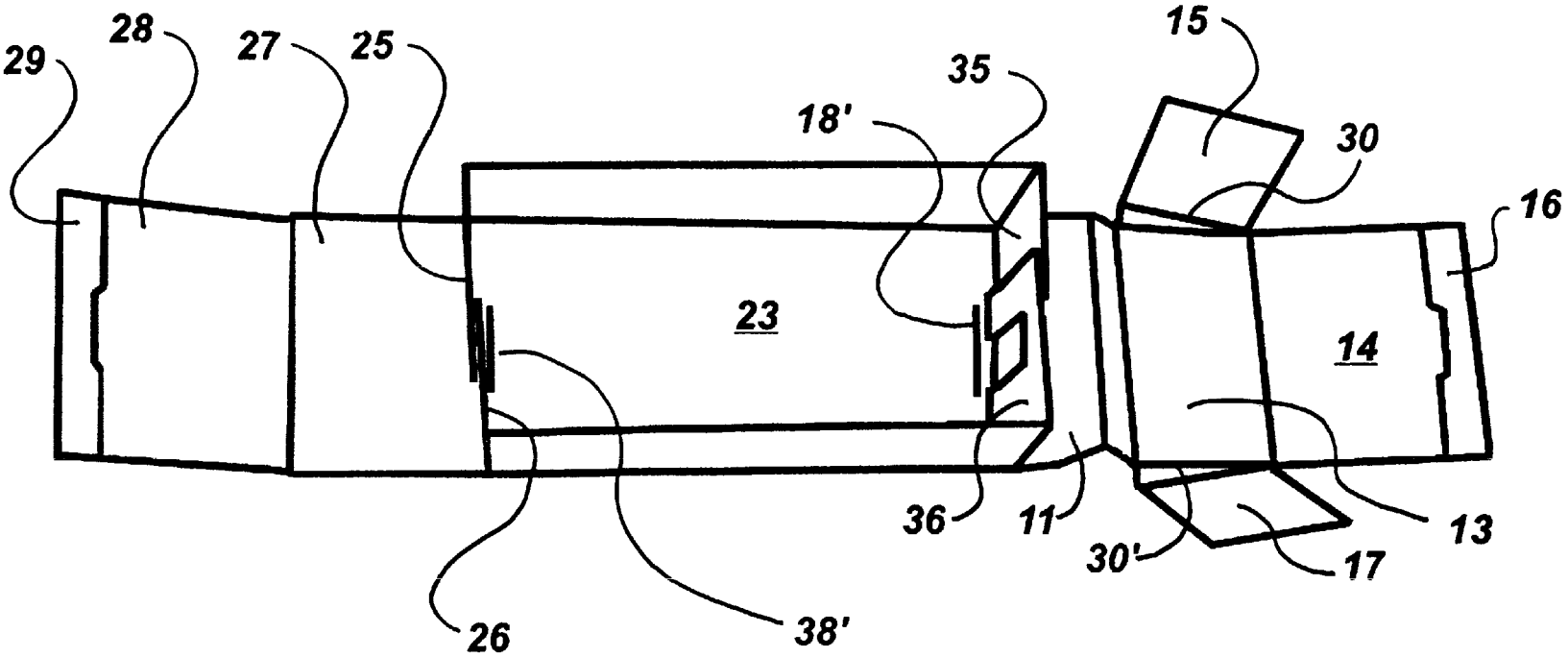

FIGS. 4–7 and 9–14 illustrate the folding and assembly of the container 20. It is best to fold and assemble the side assemblies first; either side assembly may be folded and assembled first, either by hand or by mechanical means. In this regard, each side assembly is folded up followed by folding the front-side lockable flaps 35, 37 in the direction of arrows A and B and mating the respective flaps as previously described and as illustrated in FIG. 5. This is followed by folding the rear-side lockable flaps 25, 26 in the direction of arrows A' and B' and mating these respective flaps similarly as the front-side flaps were mated. It must be understood that the extension tabs 45, 46 may be exposed as illustrated in FIG. 5 or may be tucked inward and not exposed. With either method, the side assemblies securely lock together and thereby establishes four upstanding perimeter walls of the container 20.

Figure 8:
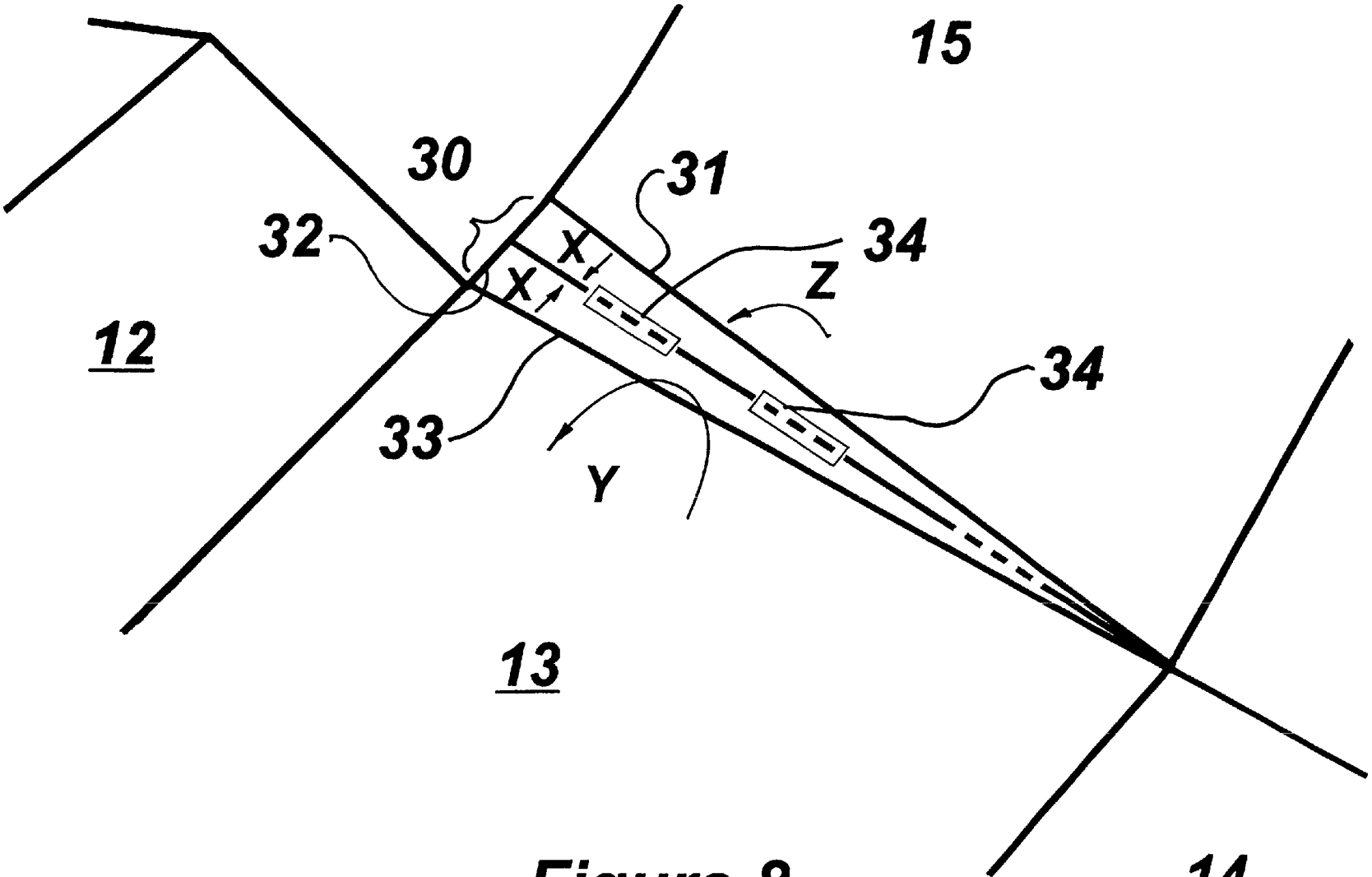
FIG. 8 is a detailed view of the expansion section of the container component.

Reference is now made to FIGS. 6–11 for completion of the front-end assembly 19. As previously discussed, the handle mechanism is formed by the first front panel 11, the second front panel 12, and the third front panel 13 in combination with extension flaps 15, 17 and the expansion section in between the third front panel 13 and its extending extension flaps 15, 17. FIG. 8 details the expansion section 30 between, and serving as the connection to, the third front panel 13 and its two extension flaps 15, 17. The expansion section 30 is an important feature of the container 20. As illustrated here, the expansion section 30 has three fold-lines 31, 32, 33. Fold-line 32 has one or more slots 34 and it, the fold-line, is folded or creased inwardly or outwardly in the direction of arrows X. Fold-line 31 is folded or creased in the direction of arrow Z and fold-line 33 is folded or creased in the direction of arrow Y. As so folded, the expansion section takes on an accordion-like appearance and function. The slots 34 facilitate it compressibility. It must be understood that there may be more than three fold-lines as illustrated and that one or more slots 34 may be inserted into any one or more of the fold-lines. Ease of construction, assembly, and use militates in favor of three fold-lines as shown with one or more slots 34 in the middle fold-line 32.

Figure 9:
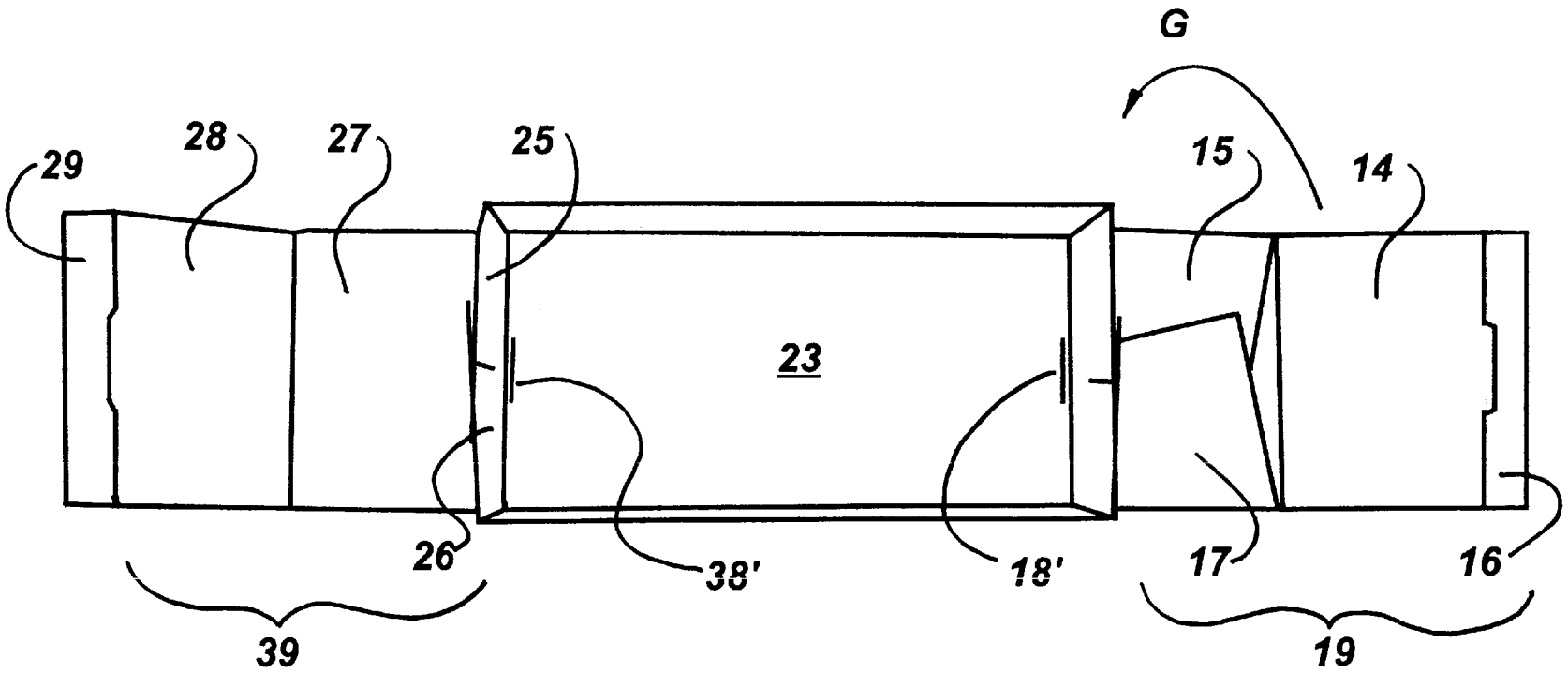
Figure 10:
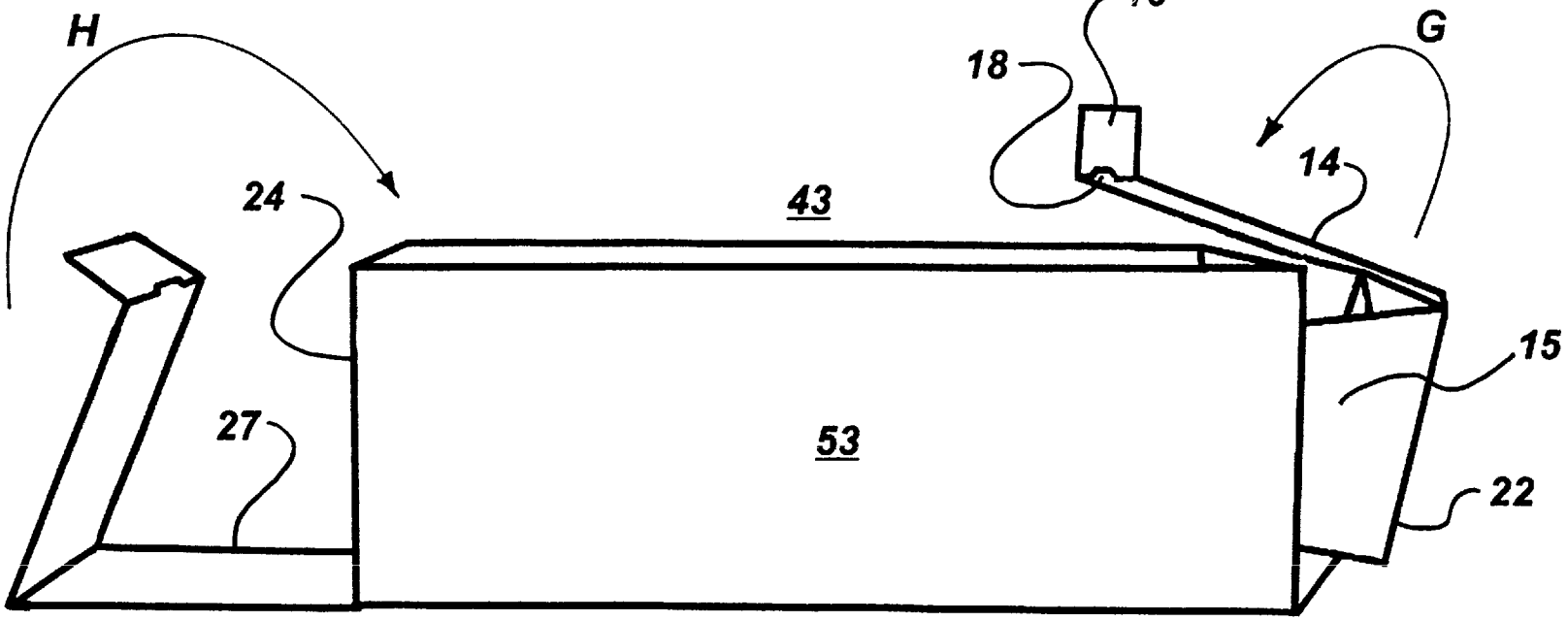
Figure 11:
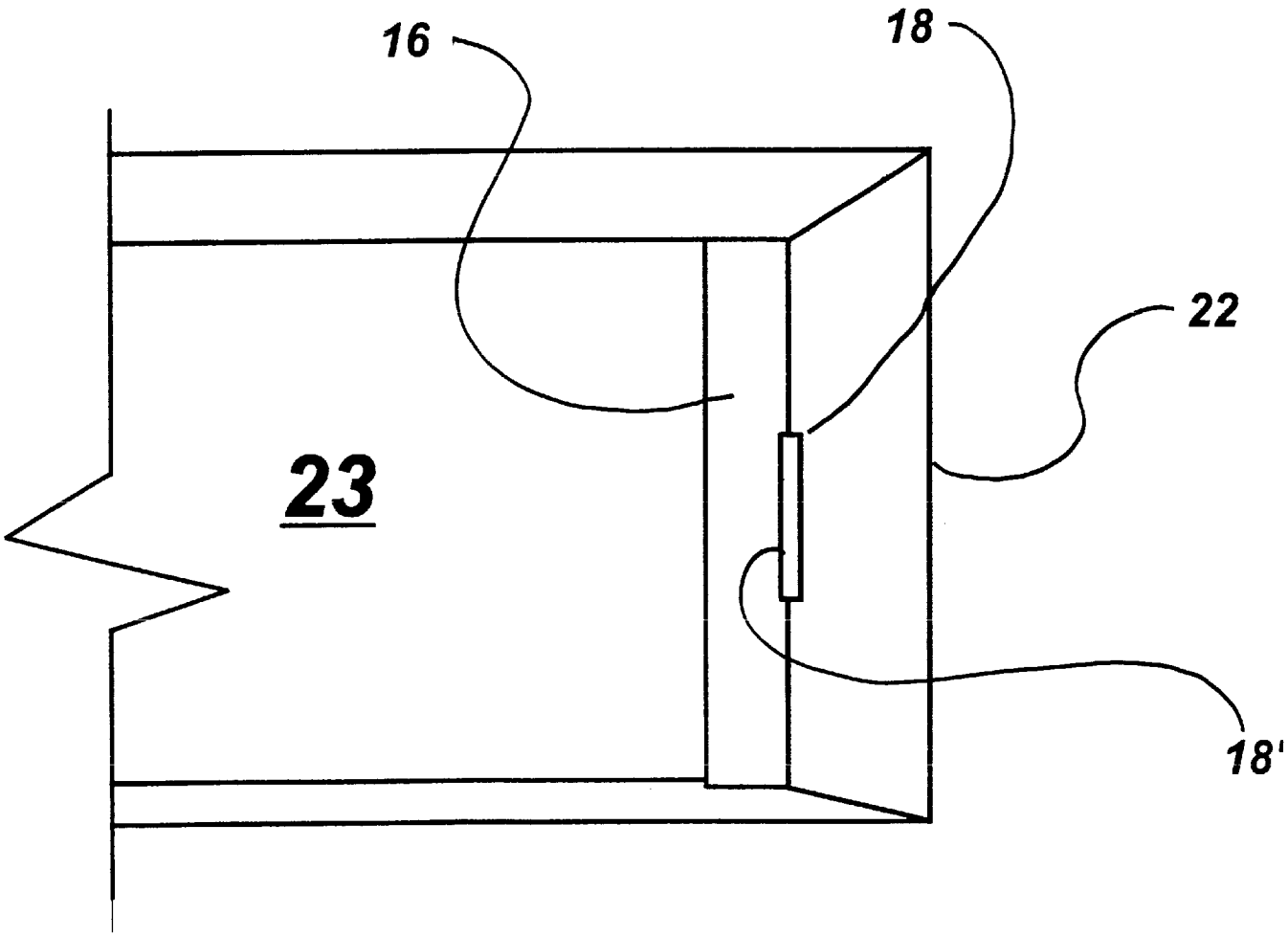
Figure 12:
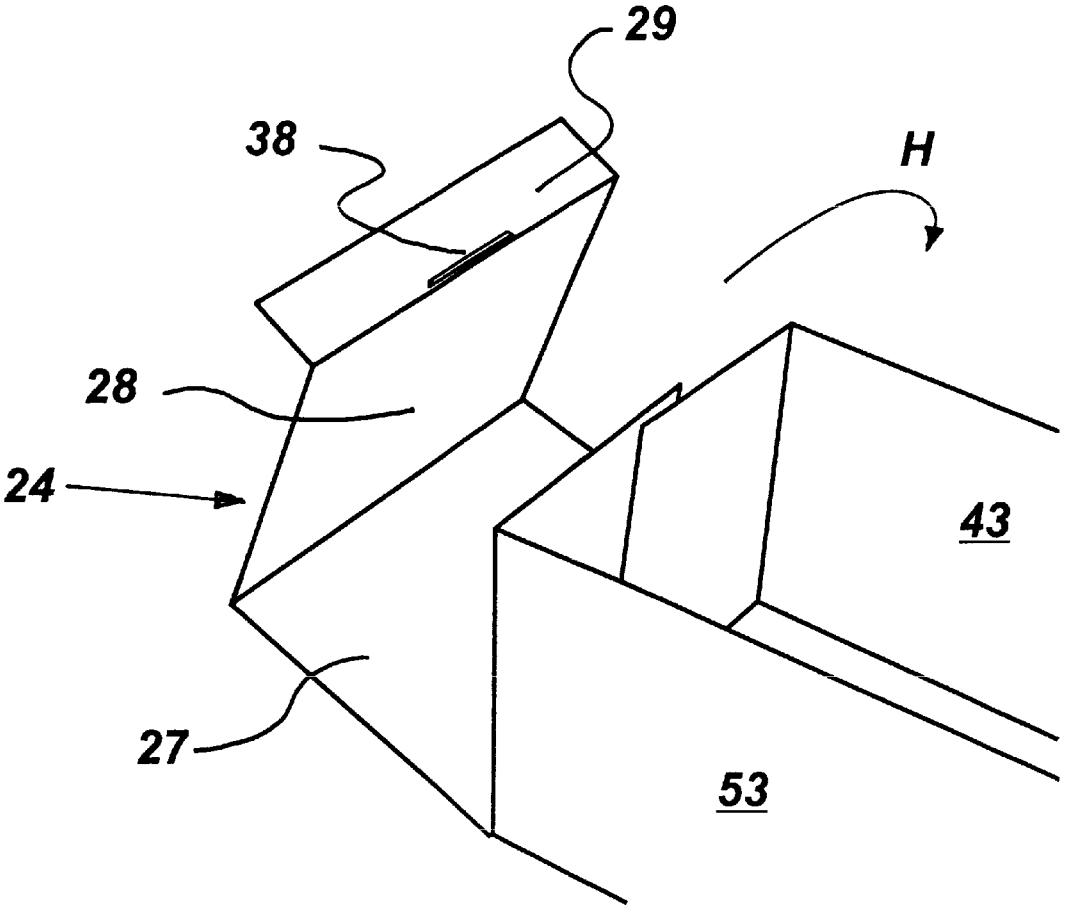
Figure 13:
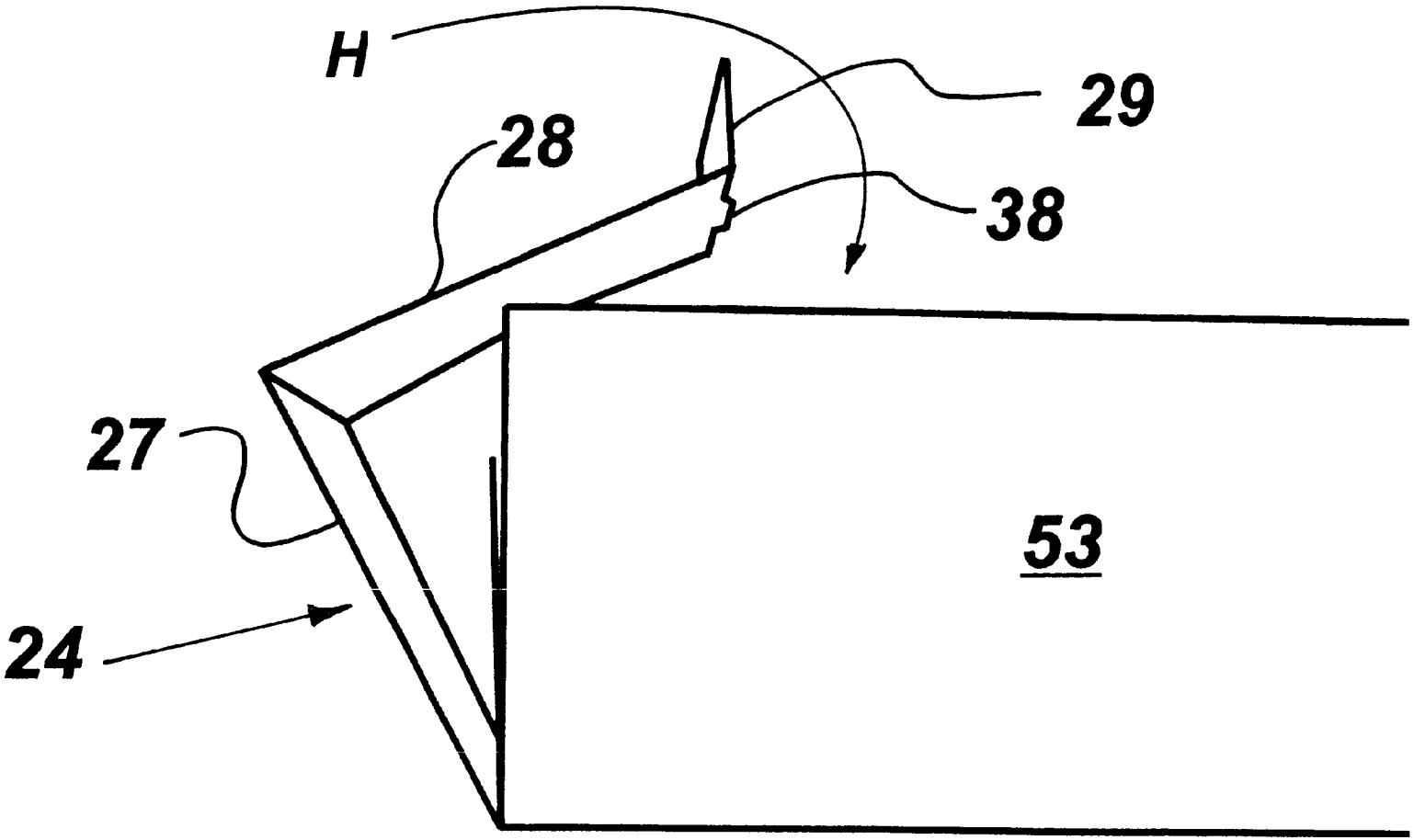
Figure 14:
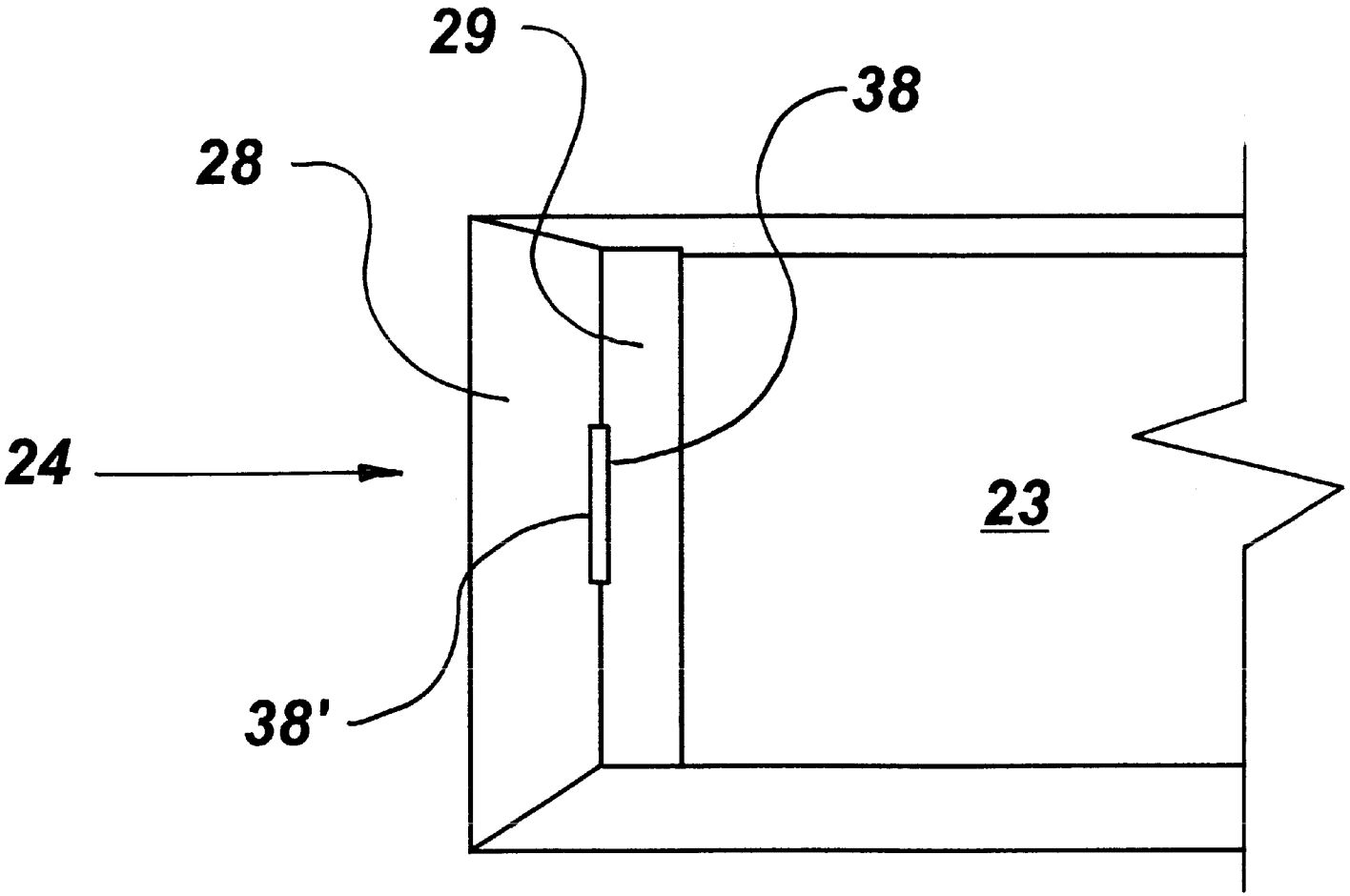

After the folds have been made to ready the expansion sections 30, 30' on both extension flaps 15, 17 but, before the extension flaps 15, 17 are folded, the first front panel 11 should be folded upward and inward, in the direction of arrow C followed by the downward and inward folding of the second front panel 12 in the direction of arrow D. As so folded, these front panels 11, 12 resemble an up-side-down "V". The third front panel 13 is then folded upward and inward, in the direction of arrow E. This is followed by the inward folding, in the direction of arrows F, of the extension flaps 15, 17 over the first front panel 11. FIG. 9 represents the result of these folds.

The front-end assembly 19 is completed by folding the fourth front panel 14 and, in the direction of arrow G, carrying it over and into the container 20 to the bottom and inserting the tab 18 into the receiving slot 18' thereat. Although a fifth front panel 16 is not required, it is preferred in that it protects and better secures the tab 18 to receiving slot 18' connection. The front-end assembly 19 is now complete and sturdy. A compressible handle mechanism extends from the front end and is suitable for grabbing, holding, and moving the container into and out of the sleeve 70.

The container 20 is completed with the folding and carrying over, in the direction of arrow H, of the rear-end assembly 39 and, similar to the assembly of the front-end assembly 19, insertion of the tab 38 into the receiving slot 38'. Similar to the front-end assembly 19, the third rear panel 29, though not necessary, is preferred as it too protects and better secures in place the rear-end assembly tab 38 to receiving slot 38' connection.

Figure 15:
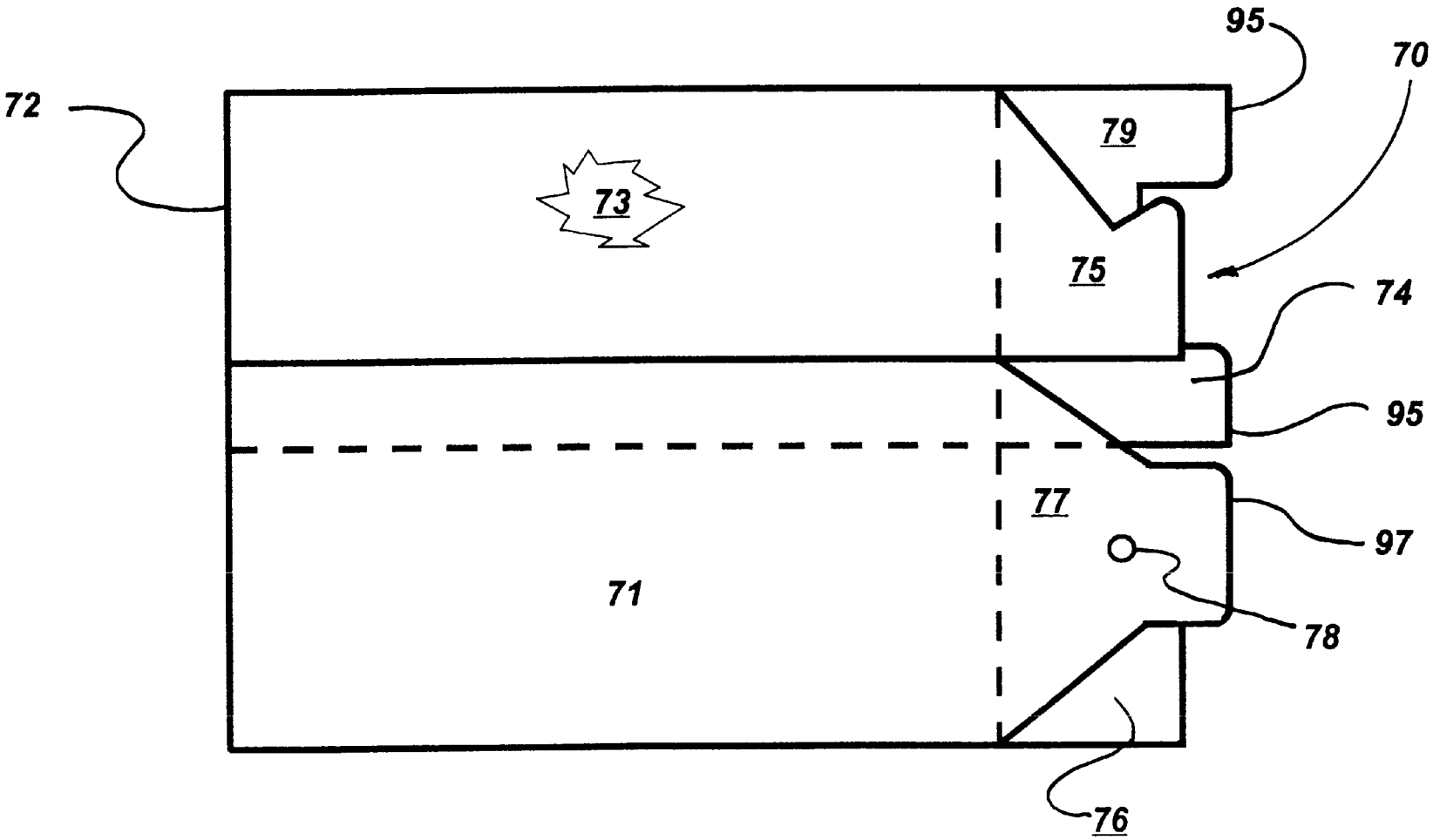
FIG. 15 is a plan view of the unassembled sleeve component of the box assembly.
Figure 16:
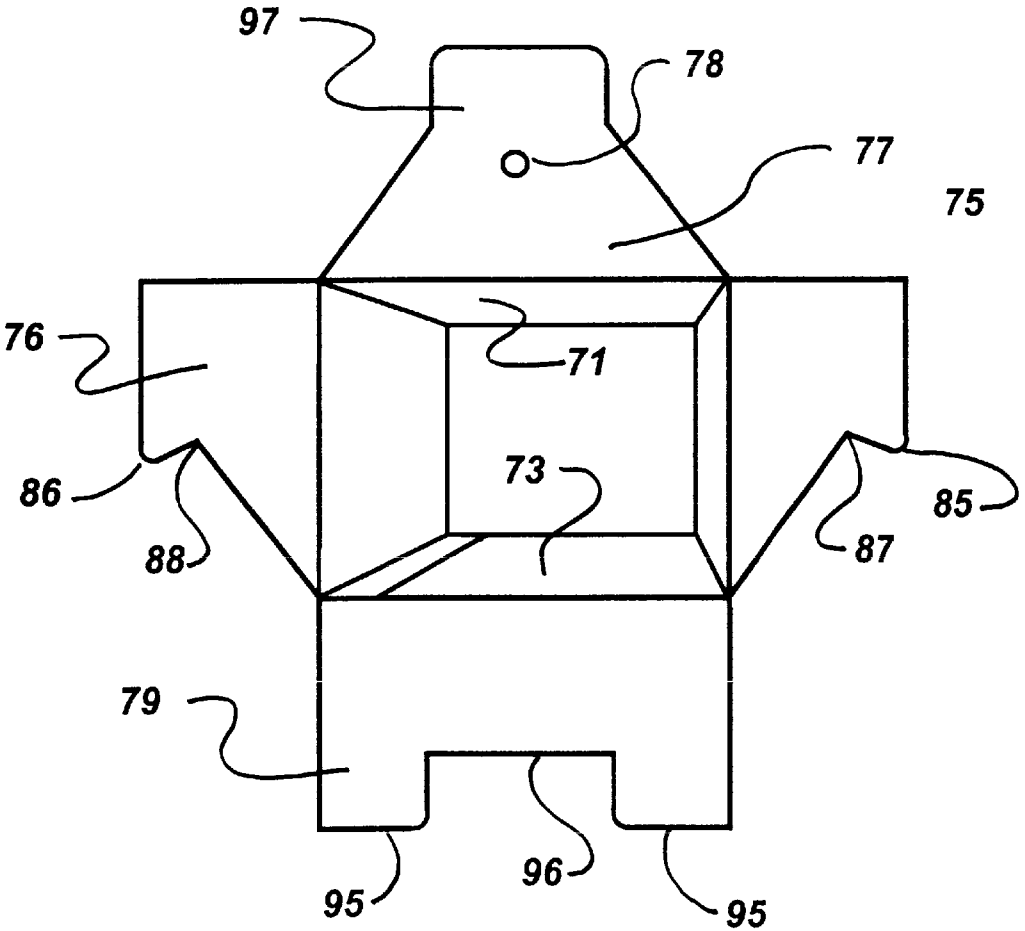
FIGS. 16–20 are views of the sleeve component in various stages of assembly.

FIGS. 15–20 illustrate the sleeve 70 component of the box assembly 10. The sleeve 70 is generally formed from a single flat blank with fold lines folded and the ends fastened by glue, a self-adhesive strip, or similar means to thereby form a collapsible basically rectangular hollow into which the container 20 may be insertable and removable. FIG. 15 illustrates the sleeve 70 in its knock-down, collapsed state. FIG. 16 illustrates the sleeve 70, from the rear, in an uncollapsed or open state ready for assembly. The sleeve 70 has a foldable top rear flap 77, a foldable bottom rear flap 79 and two foldable rear side flaps 75, 76. The top rear flap 77 has inward and upward angled sides terminating at and creating a top extension flap 97. It also has a hole or vent 78 which facilitates the insertion and removal of the container 20. The vent 78 is shown on the top rear flap 77 but instead may be on the bottom rear flap 79, or on either rear side flap 75, 76, or any combination thereof. The bottom rear flap 79 has a depression or channel 96 centered on its outer edge and two step taps 95 extending farther outward beyond the channel 96. Each rear side flap 75, 76 has a protruding tab 85, 86 and groove 87, 88, respectively.

Figure 17:
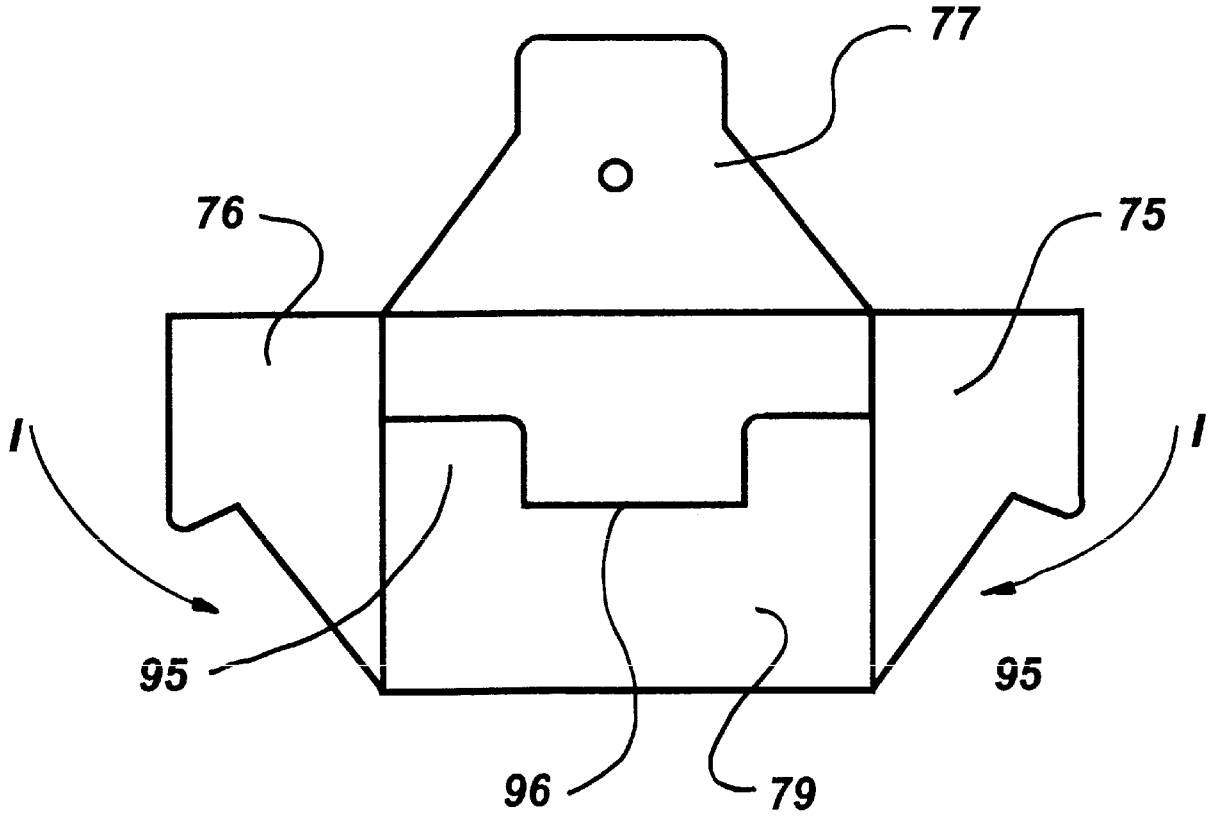
Figure 18:
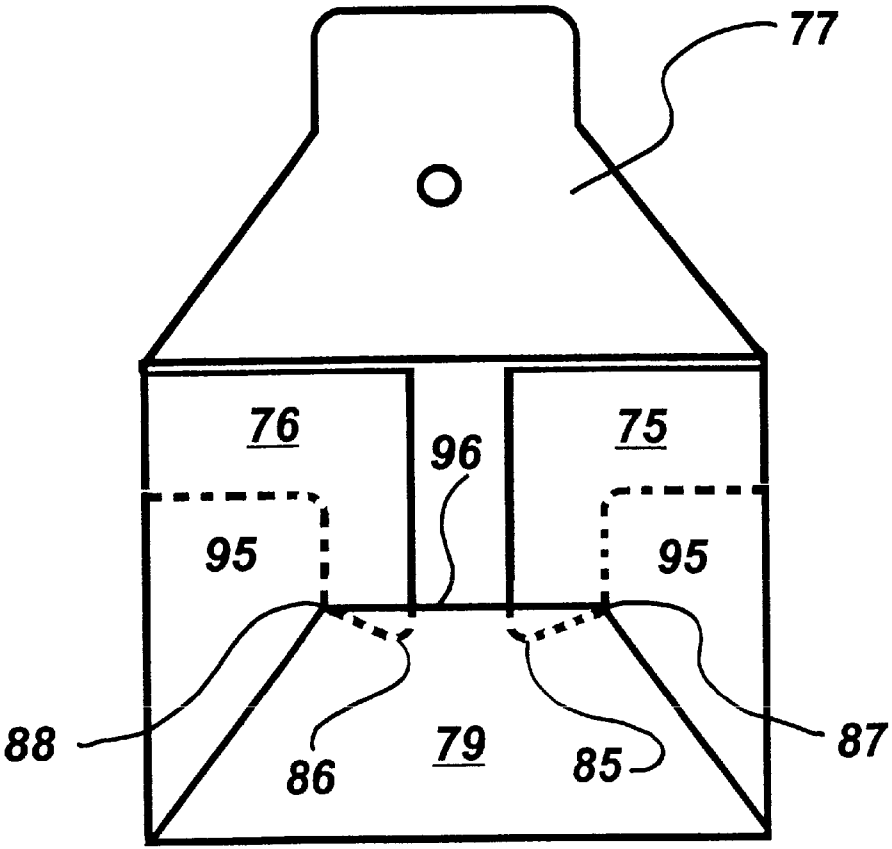
Figure 19:
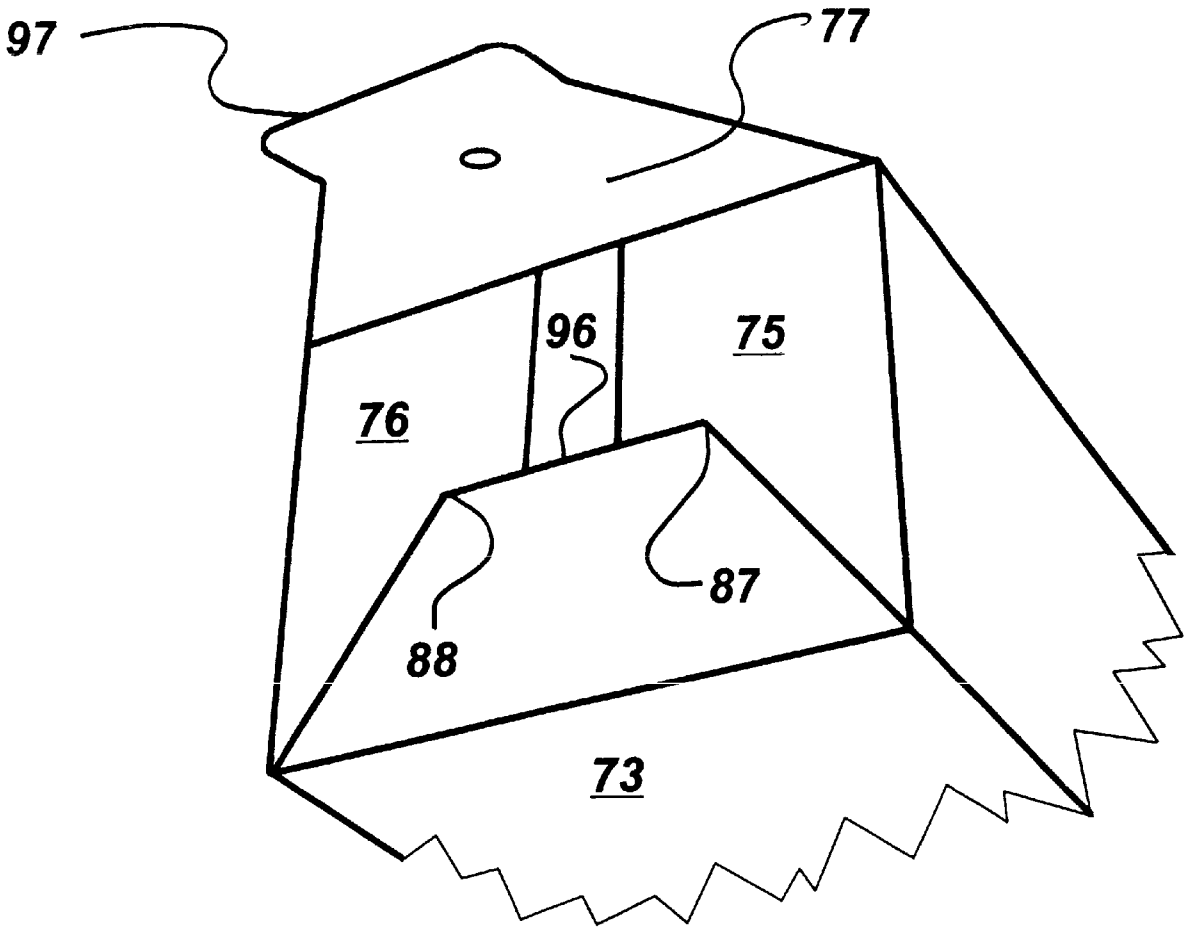
Figure 20:
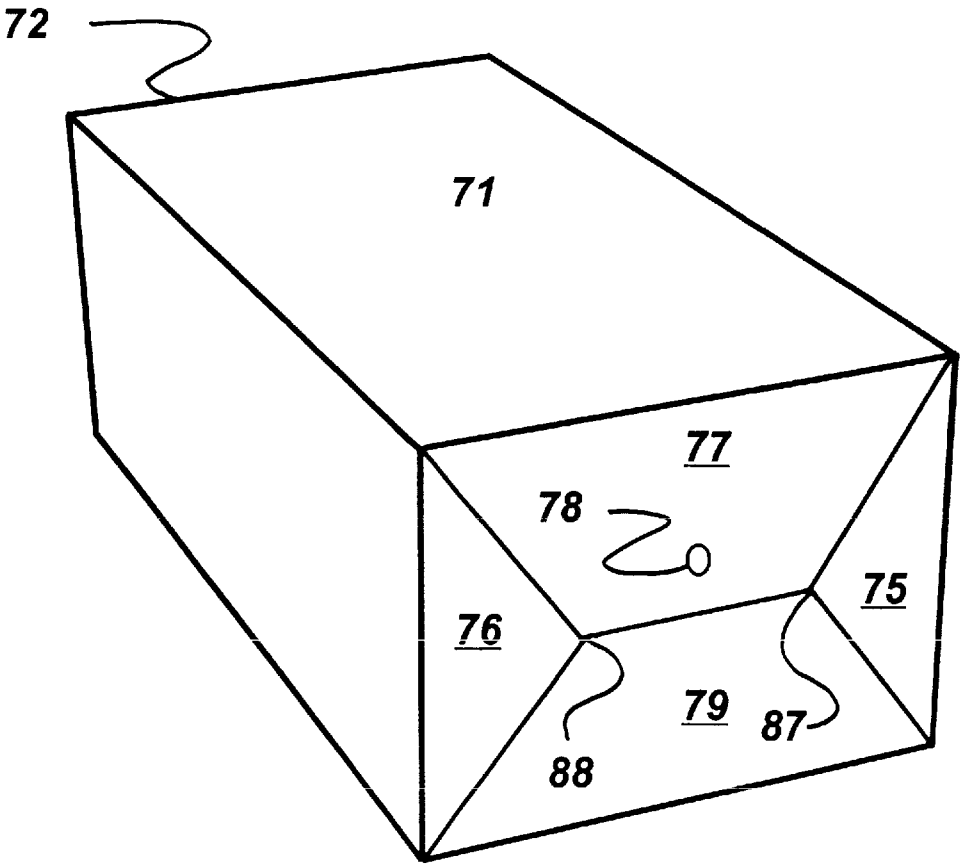

Assembly of the sleeve 70 entails folding the bottom rear flap 70 upward to resemble the sleeve 70 as depicted in FIG. 17. This is followed by the inward folding of each rear side flap 75, 76 in the direction of arrows I and inserting the respective protruding tabs 85, 86 over the channel 96 and into the sleeve 70. The result of this operation is depicted in FIG. 18. Next the top rear flap 77 is folded downward and the top extension flap 97 inserted over the channel 96 and into the sleeve 70. As assembled, the top extension flap 97 is seated in between the bottom rear flap 79 and the protruding tabs 85, 86, and such configuration forms a walled rear for the sleeve 70 and a stop for the container 20. The box assembly 10 is now ready for full use and stacking without experiencing excess damage from shipping or use.

The components (container 20 and sleeve 70) of the box assembly 10 each come with fold or crease lines and cuts, slits, or slots as described herein already incorporated in the respective component.

The present disclosure includes that contained in the present claims as well as that of the foregoing description. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention. Accordingly, the scope of the invention should be determined not by the embodiments illustrated, but by the appended claims and their legal equivalents.

What is claimed is:

1. A foldable box assembly comprising:

a container having a bottom with a front, a rear, a receiving slot at its front, and a receiving slot at its rear;

a front-end assembly-foldably connected to the front of said bottom which, when folded, comprises a front side of said container and further comprises a biasable handle means for gripping said container thereat, said front-end assembly further comprising at least four foldable front panels extending linearly frontward from said bottom wherein;

(a) the first front panel, the second front panel, and the third front panel of said at least four foldable front panels, when said front-end assembly is folded and assembled, comprise said handle means;

(b) the third front panel further comprises a foldable extension flap and an compressible and expandable expansion section, having at least two sections and at least three fold lines, on each side of said third front panel which establishes biasability for said handle means;

(c) the fourth front panel of said at least four foldable front panels further comprises a tab which, when said front-end assembly is folded, inserts into said receiving slot at the front of said bottom to secure said front-end assembly thereat;

a rear-end assembly foldably connected to the rear of said bottom which, when folded, forms a rear side of said container;

a first side assembly foldably connected to one side of said bottom which, when folded, forms one side of said container; and a second side assembly foldably connected to another side of said bottom which, when folded, forms another side of said container.

2. The invention as defined in claim 1 further comprising a collapsible sleeve which when assembled forms an open front for said sleeve to accept the insertion and removal of said container and further forms a walled rear for said sleeve to thereby securely maintain the sleeve as so formed, said sleeve comprising a foldable rear-side flap on each side of said sleeve, a foldable bottom rear flap, a foldable top rear flap, and a vent in said walled rear.

3. The invention as defined in claim 2 wherein said bottom rear flap further comprises two step tabs on each side with a channel formed in between.

4. The invention as defined in claim 3 wherein said rear-side flaps each have a groove and a protruding tab extending outward of said groove wherein, after said-bottom rear flap is folded upward and said rear-side flaps are folded inward, the protruding tabs of each of said rear-side flaps are inserted over and into the channel of said bottom rear flap.

5. The invention as defined in claim 4 wherein said top rear flap comprises angled sides and a top extension flap outward of said angled sides wherein after said top rear flap is folded downward, said top extension flap is inserted over and into said channel such that the top extension flap is set in between the protruding tabs and the bottom rear flap.

6. The invention as defined in claim 1 wherein said fourth front panel is approximately equal in height as the height of the first-side assembly and the second-side assembly.

7. The invention as defined in claim 1 wherein said expansion sections each comprise at least three fold lines and one or more slots in one or more of said at least three fold lines.

8. The invention as defined in claim 1 further comprising a fifth front panel which, when said front-end assembly is folded and assembled, covers the receiving slot at the front of the bottom of said container.

9. The invention as defined in claim 1 wherein said rear-end assembly comprises at least two foldable rear panels extending rearward from said bottom wherein the second rear panel of said at least two foldable rear panels further comprises a tab which, when said rear-end assembly is folded, inserts into said receiving slot at the rear of said bottom to secure said rear-end assembly thereat.

10. The invention as defined in claim 9 wherein said first rear panel of said at least two foldable rear panels and said second rear panel are approximately equal in height as the height of the first-side assembly and the second-side assembly.

11. The invention as defined in claim 9 further comprising a third rear panel which, when said rear-end assembly is folded and assembled, covers the receiving slot at the rear of the bottom of said container.

12. The invention as defined in claim 1 wherein said side assembly further comprising a locking means for securely connecting said first-side assembly to said second-side assembly.

13. The invention as defined in claim 12 wherein said locking means comprises a lockable flap on the front and one on the rear of said first-side assembly and a cooperating lockable flap on the front and one on the rear of said second-side assembly, each said lockable flap further comprising an extension tab and a slit thereon whereby said extension tabs and said slits on the front and rear of said first-side assembly are lockingly matable respectively with said extension tabs and said slits on the front and rear of said second-side assembly when each said side assembly is folded into an upright position.

* * * * *